US012723331B2

(12) United States Patent
Rosenberg et al.

(10) Patent No.: US 12,723,331 B2
(45) Date of Patent: Sep. 1, 2026

(54) FABRIC WITH ELECTRICAL COMPONENTS

(71) Applicant: Apple Inc., Cupertino, CA (US)

(72) Inventors: Andrew L Rosenberg, Sunnyvale, CA (US); Kathryn P Crews, Menlo Park, CA (US); Didio V Gomes, Sunnyvale, CA (US); Weibing Gong, San Jose, CA (US); Benjamin J Grena, San Francisco, CA (US); Francois R Jacob, Sunnyvale, CA (US); Maurice P May, Sunnyvale, CA (US); Daniel A Podhajny, Morgan Hill, CA (US); Lia M Uesato, San Jose, CA (US)

(73) Assignee: Apple Inc., Cupertino, CA (US)

( * ) Notice: Subject to any disclaimer, the term of this patent is extended or adjusted under 35 U.S.C. 154(b) by 94 days.

(21) Appl. No.: 18/735,935

(22) Filed: Jun. 6, 2024

(65) Prior Publication Data

US 2024/0417895 A1 Dec. 19, 2024

Related U.S. Application Data

(60) Provisional application No. 63/507,830, filed on Jun. 13, 2023.

(51) Int. Cl.
*D03D 1/00* (2006.01)
*D03D 13/00* (2006.01)
(Continued)

(52) U.S. Cl.
CPC ..... *D03D 1/0088* (2013.01); *D03D 13/00* (2013.01); *D03D 25/00* (2013.01); *D04B 21/202* (2013.01);
(Continued)

(58) Field of Classification Search
CPC ..... D04B 27/10; D04B 27/12; D04B 27/14; D04B 27/16; D04B 27/18; D04B 27/20; D04B 27/22
See application file for complete search history.

(56) References Cited

U.S. PATENT DOCUMENTS 231,809 A 8/1880 Hardaker
1,812,506 A 6/1931 Willits
(Continued)

FOREIGN PATENT DOCUMENTS

CN 1322837 C * 6/2007 ..... D02G 3/441

*Primary Examiner* — Danny Worrell
(74) *Attorney, Agent, or Firm* — Treyz Law Group, P.C.; Kendall P. Woodruff

(57) ABSTRACT

Interlacing equipment may be used to form fabric. A component detector may be used to feed strands such as a conductive strand to the interlacing equipment. One or more electrical components may be mounted to the conductive strand. The component detector may have a sensor configured to detect the presence of the electrical component as the conductive strand is fed to the interlacing equipment through the component detector. In response to detecting the component with the sensor, the interlacing equipment may automatically adjust interlacing operations in preparation for receiving the electrical component. For example, needles may be lowered in a knitting system, select warp strands may be raised and lowered in a weaving system, or a carrier may follow a modified path in a braiding system in response to detecting the electrical component. The fabric may have a different construction in regions where the electrical component is received.

20 Claims, 12 Drawing Sheets

(51) Int. Cl.
*D03D 25/00* (2006.01)
*D04B 21/20* (2006.01)
*D04C 3/00* (2006.01)

(52) U.S. Cl.
CPC ..... *D04C 3/00* (2013.01); *D10B 2401/16* (2013.01); *D10B 2401/18* (2013.01)

(56) References Cited

U.S. PATENT DOCUMENTS 2,113,492 A 4/1938 Philippe
4,140,156 A 2/1979 Trost
4,804,806 A 2/1989 Orr, Jr. et al.
5,435,352 A 7/1995 Yamamoto et al.
5,771,793 A 6/1998 Kayser
5,783,278 A 7/1998 Nishimura et al.
6,431,220 B1 8/2002 Nakada et al.
6,888,112 B2 5/2005 Rock et al.
7,022,917 B2 4/2006 Jung et al.
7,144,830 B2 12/2006 Hill et al.
7,299,827 B1 11/2007 Minamitani et al.
7,592,276 B2 * 9/2009 Hill ..... D03D 15/258 313/511
7,845,022 B1 * 12/2010 Surve ..... H10D 10/311 2/243.1
8,922,100 B2 12/2014 Whinnery
9,338,915 B1 5/2016 Liu et al.
9,926,651 B2 3/2018 Khokar
10,066,829 B2 9/2018 Wong et al.
10,174,444 B1 1/2019 Podhajny et al.
10,323,344 B2 * 6/2019 Hartmann ..... D04B 15/56
10,338,757 B2 7/2019 Karagozler
10,400,364 B1 * 9/2019 Mayer ..... D03D 15/25
10,485,103 B1 * 11/2019 Sunshine ..... H01L 23/49838
10,550,497 B1 2/2020 Sunshine et al.
10,645,851 B2 5/2020 Kondo
10,772,209 B2 9/2020 Sunshine et al.
10,851,481 B1 12/2020 Sunshine et al.
10,900,154 B2 * 1/2021 Podhajny ..... F21V 19/0025
10,910,315 B2 2/2021 Sunshine et al.
11,076,664 B1 8/2021 Podhajny et al.
11,401,632 B2 8/2022 Bogan et al.
2006/0281382 A1 * 12/2006 Karayianni ..... D02G 3/32 442/306
2007/0049147 A1 3/2007 Hill et al.
2009/0035530 A1 2/2009 Speich
2009/0146790 A1 6/2009 Speich
2009/0253325 A1 10/2009 Brookstein et al.
2010/0051699 A1 3/2010 Speich
2010/0085166 A1 4/2010 Speich
2013/0186505 A1 7/2013 Cross et al.
2013/0190917 A1 7/2013 Cross et al.
2015/0294756 A1 10/2015 Ben Shalom et al.
2017/0251555 A1 8/2017 Sunshine et al.
2018/0010269 A1 * 1/2018 Hartmann ..... D04B 15/56
2018/0195218 A1 * 7/2018 Hamada ..... D04B 27/32
2018/0240396 A1 * 8/2018 Fontecchio ..... D04B 21/14
2019/0013274 A1 1/2019 Sunshine et al.
2019/0160279 A1 5/2019 Farah
2019/0242036 A1 8/2019 Bogan et al.
2020/0087823 A1 3/2020 Coxeter et al.
2020/0157714 A1 * 5/2020 Podhajny ..... D04B 21/14

* cited by examiner

FABRIC WITH ELECTRICAL COMPONENTS

This application claims the benefit of U.S. provisional patent application No. 63/507,830, filed Jun. 13, 2023, which is hereby incorporated by reference herein in its entirety.

FIELD

This relates generally to items with fabric and, more particularly, to items with fabric and electrical components.

BACKGROUND

It may be desirable to form bags, furniture, clothing, and other items from materials such as fabric. Fabric items generally do not include electrical components. It may be desirable, however, to incorporate electrical components into fabric to provide a user of a fabric item with enhanced functionality.

It can be challenging to incorporate electrical components into fabric. Fabric is flexible, so it can be difficult to mount structures to fabric. Electrical components must be coupled to signal paths (e.g., signal paths that carry data signals, power, etc.), but unless care is taken, signal paths may be damaged, or components may become dislodged as fabric is bent and stretched.

It would therefore be desirable to be able to provide improved techniques for incorporating electrical components into items with fabric.

SUMMARY

Interlacing equipment (e.g., weaving equipment, knitting equipment, braiding equipment, etc.) may be provided with individually adjustable components. The use of individually adjustable components may allow electrical components to be inserted into and/or embedded in the fabric during the formation of the fabric.

A component detector may be used to feed strands such as a conductive strand to the interlacing equipment. One or more electrical components may be mounted to the conductive strand. The component detector may have a sensor configured to detect the presence of the electrical component as the conductive strand is fed to the interlacing equipment through the component detector. In response to detecting the component with the component detector, the interlacing equipment may automatically adjust interlacing operations in preparation for receiving the electrical component. For example, needles may be lowered in a knitting system, select warp strands may be raised and lowered in a weaving system, or a carrier may follow a modified path in response to the component detector detecting the electrical component.

The fabric may have a different construction in regions where the electrical component is received. For example, component receiving regions may have pockets and/or may include one or more floats in which the conductive strand is floating relative to other strands in the fabric. These component receiving regions may automatically be formed by the interlacing equipment in response to detecting the electrical component with the component detector.

DETAILED DESCRIPTION

Electronic devices, enclosures, and other items may be formed from fabric such as woven fabric, knit fabric, braided fabric, and/or other suitable fabric. The fabric may include strands of insulating and conductive material. Conductive strands may form signal paths through the fabric and may be coupled to electrical components such as light-emitting diodes and other light-emitting devices, integrated circuits, sensors, haptic output devices, and other circuitry.

Interlacing equipment (sometimes referred to as intertwining equipment) may include weaving equipment, knitting equipment, braiding equipment, or any other suitable equipment used for crossing, looping, overlapping, or otherwise coupling strands of material together to form a network of strands (e.g., fabric). Interlacing equipment may be provided with individually adjustable members such as warp strand positioning equipment (e.g., heddles or other warp strand positioning equipment), weft strand positioning equipment, a reed, take-down equipment, let off equipment (e.g., devices for individually dispensing and tensioning warp strands), needle beds, feeders, guide bars, strand processing and component insertion equipment, carriers, and other components for forming fabric items. The individual adjustability of these components may allow interlacing operations (e.g., weaving operations, knitting operations, braiding operations, and/or other interlacing operations) to be performed without requiring continuous lock-step synchronization of each of these devices, thereby allowing fabric with desired properties to be woven.

One or more electrical components may be mounted and electrically connected to a conductive strand. The conductive strand may be fed to interlacing equipment (e.g., knitting equipment, weaving equipment, braiding equipment, etc.) through a component detector (sometimes referred to as a feeder). The component detector may receive the conductive strand from a strand source and may feed the conductive strand to the interlacing equipment. As the conductive strand passes through the component detector, electrical components that are mounted to the conductive strand may be detected when the electrical components reach the component detector. In response to detecting the electrical component, a controller may automatically adjust one or more components of the interlacing equipment in preparation for receiving the electrical component. This may include adjusting needles and/or guide bars in a knitting system, adjusting warp strand positioners in a weaving system, adjusting carriers in a braiding system, and/or adjusting other members in the interlacing equipment.

Figure 1:
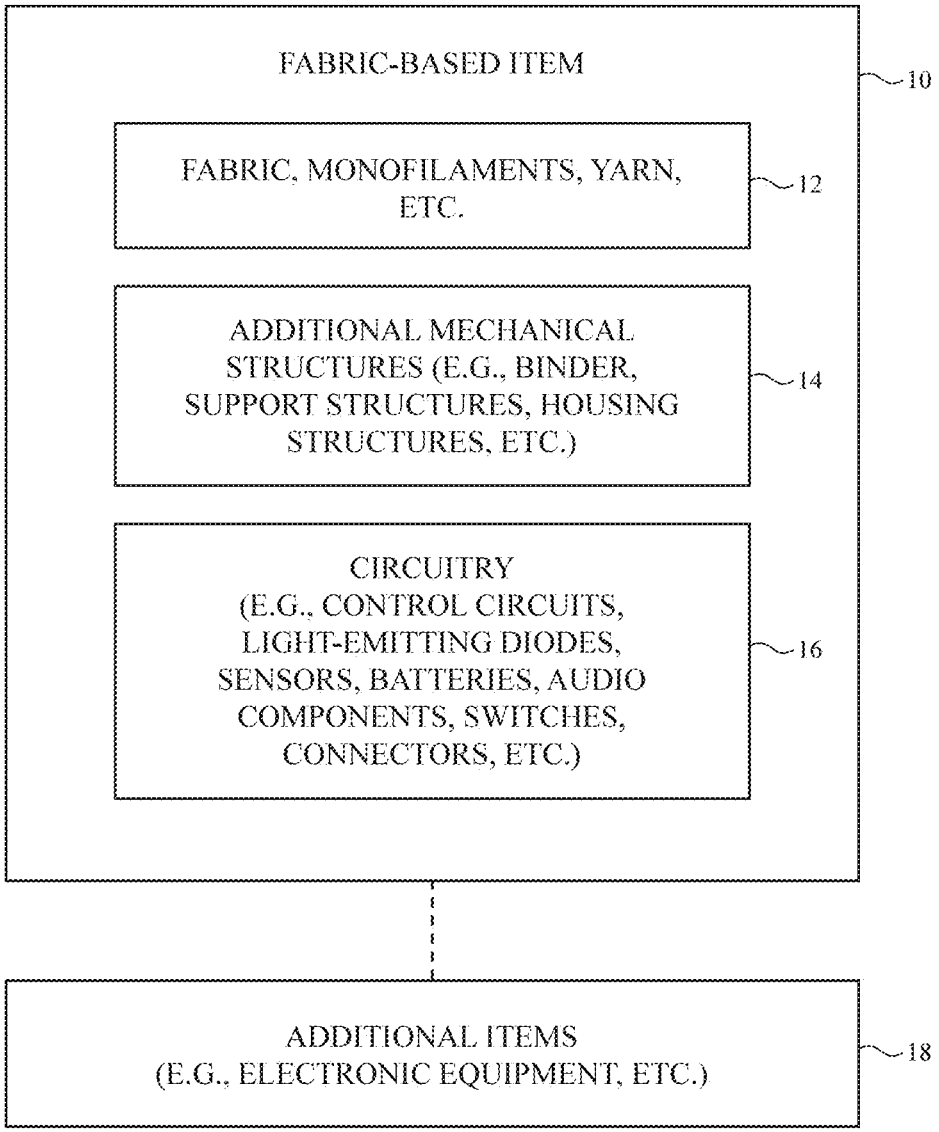
FIG. 1 is a schematic diagram of an illustrative fabric item in accordance with an embodiment.

Items such as item 10 of FIG. 1 may include fabric and may sometimes be referred to as a fabric item or fabric-based item. Item 10 may be an electronic device or an accessory for an electronic device such as a laptop computer, a computer monitor containing an embedded computer, a tablet computer, a cellular telephone, a media player, or other handheld or portable electronic device, a smaller device such as a wrist-watch device, a pendant device, a headphone or earpiece device, a device embedded in eyeglasses or other equipment worn on a user's head, or other wearable or miniature device, a television, a computer display that does not contain an embedded computer, a gaming device, a navigation device, an embedded system such as a system in which fabric item 10 is mounted in a kiosk, in an automobile, airplane, or other vehicle (e.g., an autonomous or non-autonomous vehicle), other electronic equipment, or equipment that implements the functionality of two or more of these devices. If desired, item 10 may be a removable external case for electronic equipment, may be a strap, may be a wrist band or head band, may be a removable cover for a device, may be a case or bag that has straps or that has other structures to receive and carry electronic equipment and other items, may be a necklace or arm band, may be a wallet, sleeve, pocket, or other structure into which electronic equipment or other items may be inserted, may be part of a chair, sofa, or other seating (e.g., cushions or other seating structures), may be part of an item of clothing or other wearable item (e.g., a hat, belt, wrist band, headband, etc.), or may be any other suitable item that incorporates fabric.

Item 10 may include interlaced strands of material such as monofilaments and yarns that form fabric 12. As used herein, "interlaced" strands of material and "intertwined" strands of material may both refer to strands of material that are crossed with one another, looped with one another, overlapping one another, or otherwise coupled together (e.g., as part of a network of strands that make up a fabric). Fabric 12 may form all or part of a housing wall or other layer in an electronic device, may form internal structures in an electronic device, or may form other fabric-based structures. Item 10 may be soft (e.g., item 10 may have a fabric surface that yields to a light touch), may have a rigid feel (e.g., the surface of item 10 may be formed from a stiff fabric), may be coarse, may be smooth, may have ribs or other patterned textures, and/or may be formed as part of a device that has portions formed from non-fabric structures of plastic, metal, glass, crystalline materials, ceramics, or other materials.

The strands of material used in forming fabric 12 may be single-filament strands (sometimes referred to as fibers) or may be threads, yarns, or other strands that have been formed by interlacing multiple filaments of material together. Strands may be formed from polymer, metal, glass, graphite, ceramic, natural materials such as cotton or bamboo, or other organic and/or inorganic materials and combinations of these materials. Conductive coatings such as metal coatings may be formed on non-conductive strands (e.g., plastic cores) to make them conductive. Reflective coatings such as metal coatings may be applied to strands to make them reflective. Strands may also be formed from single-filament metal wire (e.g., bare metal wire), multifilament wire, or combinations of different materials. Strands may be insulating or conductive.

Strands in fabric 12 may be conductive along their entire lengths or may have conductive portions. Strands may have metal portions that are selectively exposed by locally removing insulation (e.g., to form connections with other conductive strand portions and/or to form connections with electrical components). Strands may also be formed by selectively adding a conductive layer to a portion of a non-conductive strand.). Threads and other multifilament yarns that have been formed from interlaced filaments may contain mixtures of conductive strands and insulating strands (e.g., metal strands or metal coated strands with or without exterior insulating layers may be used in combination with solid plastic strands or natural strands that are insulating). In some arrangements, which may sometimes be described herein as an example, fabric 12 may be a woven fabric and the strands that make up fabric 12 may include warp strands and weft strands.

Conductive strands and insulating strands may be woven, knit, or otherwise interlaced to form conductive paths. The conductive paths may be used in forming signal paths (e.g., signal buses, power lines for carrying power, etc.), may be used in forming part of a capacitive touch sensor electrode, a resistive touch sensor electrode, or other input-output device, or may be used in forming other patterned conductive structures. Conductive structures in fabric 12 may be used in carrying electrical current such as power, digital signals, analog signals, sensor signals, control signals, data, input signals, output signals, or other suitable electrical signals.

Item 10 may include additional mechanical structures 14 such as polymer binder to hold strands in fabric 12 together, support structures such as frame members, housing structures (e.g., an electronic device housing), and other mechanical structures.

To enhance mechanical robustness and electrical conductivity at strand-to-strand connections and/or strand-to-component connections, additional structures and materials (e.g., solder, crimped metal connections, welds, conductive adhesive such as anisotropic conductive film and other conductive adhesive, non-conductive adhesive, fasteners, etc.) may be used in fabric 12. Strand-to-strand connections may be formed where strands cross each other perpendicularly or at other strand intersections where connections are desired. Insulating material can be interposed between intersecting conductive yarns at locations in which it is not desired to form a strand-to-strand connection. The insulating material may be plastic or other dielectric, may include an insulating strand or a conductive strand with an insulating coating or insulated conductive monofilaments, etc. Solder connections may be formed between conductive strands and/or between conductive strands and electrical components by melting solder so that the solder flows over conductive strands. The solder may be melted using an inductive soldering head to heat the solder, using hot air to heat the solder, using a reflow oven to heat the solder, using a laser or hot bar to heat the solder, or using other soldering equipment. In some arrangements, outer dielectric coating layers (e.g., outer polymer layers) may be melted away in the presence of molten solder, thereby allowing underlying metal yarns to be soldered together. In other arrangements, outer dielectric coating layers may be removed prior to soldering (e.g., using laser ablation equipment or other coating removal equipment).

Circuitry 16 may be included in item 10. Circuitry 16 may include electrical components that are coupled to fabric 12, electrical components that are housed within an enclosure formed by fabric 12, electrical components that are attached to fabric 12 using welds, solder joints, adhesive bonds (e.g., conductive adhesive bonds such as anisotropic conductive adhesive bonds or other conductive adhesive bonds), crimped connections, or other electrical and/or mechanical bonds. Circuitry 16 may include metal structures for carrying current, electrical components such as integrated circuits, light-emitting diodes, sensors, and other electrical devices. Control circuitry in circuitry 16 may be used to control the operation of item 10 and/or to support communications with item 18 and/or other devices.

Item 10 may interact with electronic equipment or other additional items 18. Items 18 may be attached to item 10 or item 10 and item 18 may be separate items that are configured to operate with each other (e.g., when one item is a case and the other is a device that fits within the case, etc.). Circuitry 16 may include antennas and other structures for supporting wireless communications with item 18. Item 18 may also interact with item 10 using a wired communications link or other connection that allows information to be exchanged.

In some situations, item 18 may be an electronic device such as a cellular telephone, computer, or other portable electronic device and item 10 may form a cover, case, bag, or other structure that receives the electronic device in a pocket, an interior cavity, or other portion of item 10. In other situations, item 18 may be a wrist-watch device or other electronic device and item 10 may be a strap or other fabric item that is attached to item 18 (e.g., item 10 and item 18 may together form a fabric-based item such as a wrist-watch with a strap). In still other situations, item 10 may be an electronic device, fabric 12 may be used in forming the electronic device, and additional items 18 may include accessories or other devices that interact with item 10. Signal paths formed from conductive yarns and monofilaments may be used to route signals in item 10 and/or item(s) 18.

The fabric that makes up item 10 may be formed from strands such as yarns (e.g., multifilament strands) and/or monofilaments that are interlaced using any suitable interlacing equipment. With one suitable arrangement, which may sometimes be described herein as an example, fabric 12 may be woven fabric formed using a weaving machine. In this type of illustrative configuration, fabric may have a plain weave, a basket weave, a satin weave, a twill weave, or variations of these weaves, may be a three-dimensional woven fabric, or may be other suitable fabric. This is, however, merely illustrative. If desired, fabric 12 may include knit fabric, warp knit fabric, weft knit fabric, braided fabric, other suitable type of fabric, and/or a combination of any two or more of these types of fabric.

Figure 2:
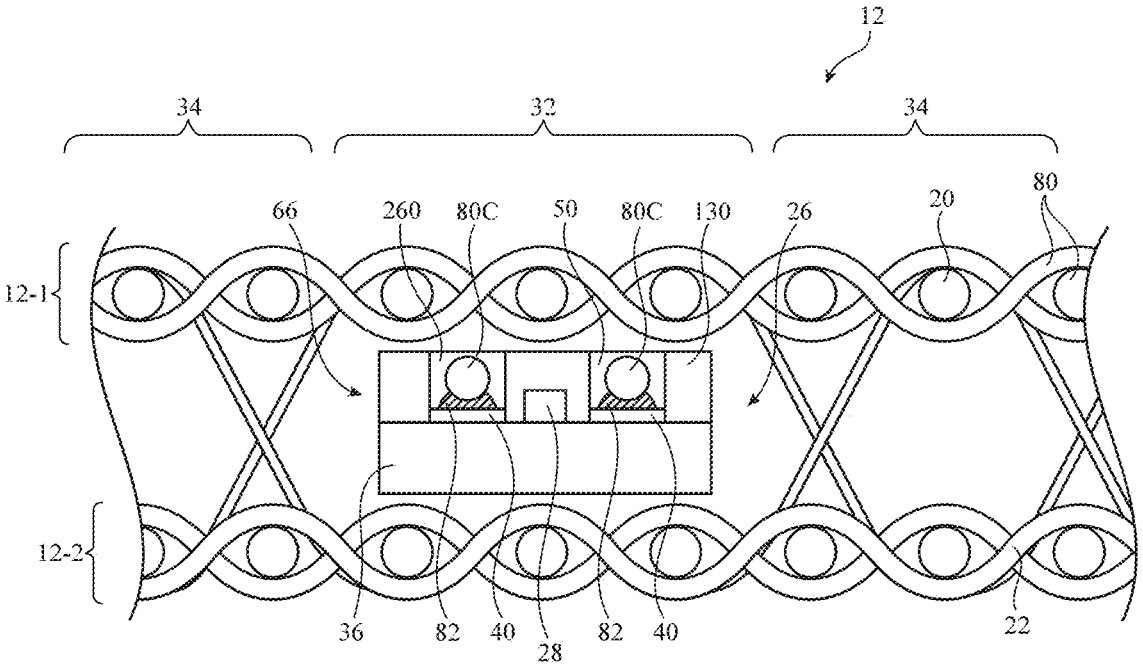
FIG. 2 is a side view of illustrative woven fabric to which an electrical component has been mounted in accordance with an embodiment.

FIG. 2 is a cross-sectional side view an illustrative fabric 12 that incorporates one or more electrical components. As shown in FIG. 2, fabric 12 may include strands 80. Strands 80 may include warp strands 20 and weft strands 22. If desired, additional strands that are neither warp nor weft strands may be incorporated into fabric 12. The example of FIG. 2 is merely illustrative. In the illustrative configuration of FIG. 2, fabric 12 has multiple layers of woven strands 80. Single-layer fabric constructions may be used for fabric 12 if desired.

As shown in FIG. 2, fabric 12 may be formed from fabric portions such as fabric portions 12-1 and 12-2. Fabric portions 12-1 and 12-2 may be formed from interlaced strands 80. For example, a first set of strands 80 may be used to form fabric portion 12-1 and a second set of strands 80 may be used to form fabric portion 12-2. Fabric portions 12-1 and 12-2 may be different portions of a single layer of fabric 12, or fabric portion 12-1 may form a first layer of fabric 12 and fabric portion 12-2 may form a second layer of fabric 12.

Electrical components in item 10 such as illustrative electrical component 26 may include discrete electrical components such as resistors, capacitors, and inductors, may include connectors, may include batteries, may include input-output devices such as switches, buttons, light-emitting components such as light-emitting diodes, audio components such as microphones and speakers, vibrators (e.g., piezoelectric actuators that can vibrate), solenoids, electromechanical actuators, motors, and other electromechanical devices, microelectromechanical systems (MEMs) devices, pressure sensors, light detectors, proximity sensors (light-based proximity sensors, capacitive proximity sensors, etc.), force sensors (e.g., piezoelectric force sensors), strain gauges, moisture sensors, temperature sensors, accelerometers, gyroscopes, compasses, magnetic sensors (e.g., Hall effect sensors and magnetoresistance sensors such as giant magnetoresistance sensors), touch sensors, and other sensors, components that form displays, touch sensors arrays (e.g., arrays of capacitive touch sensor electrodes to form a touch sensor that detects touch events in two dimensions), and other input-output devices, electrical components that form control circuitry such as non-volatile and volatile memory, microprocessors, application-specific integrated circuits, system-on-chip devices, baseband processors, wired and wireless communications circuitry, and other integrated circuits.

Electrical components such as component 26 may be bare semiconductor dies (e.g., laser dies, light-emitting diode dies, integrated circuits, etc.) or packaged components (e.g. semiconductor dies or other devices packaged within plastic packages, ceramic packages, or other packaging structures). One or more electrical terminals may be formed on body 28 of component 26. Body 28 may be a semiconductor die (e.g., a laser die, light-emitting diode die, integrated circuit, etc.) or may be a package for a component (e.g., a plastic package or other dielectric package that contains one or more semiconductor dies or other electrical devices). Contacts for body 28 may be protruding leads, may be planar contacts, may be formed in an array, may be formed on any suitable surfaces of body 28, or may be any other suitable contacts for forming electrical connections to component 26.

Body 28 may be mounted on a support structure such as interposer 36. Interposer 36 may be a printed circuit, ceramic carrier, or other dielectric substrate. Interposer 36 may be larger than body 28 or may have other suitable sizes. Interposer 36 may have a planar shape with a thickness of 700 microns, more than 500 microns, less than 500 microns, or other suitable thickness. The thickness of body 28 may be 500 microns, more than 300 microns, less than 1000 microns, or other suitable thickness. The footprint (area viewed from above) of body 28 and interposer 36 may be 10 microns×10 microns, 100 microns×100 microns, more than 1 mm×1 mm, less than 10 mm×10 mm, may be rectangular, may be square, may have L-shapes, or may have other suitable shapes and sizes.

Interposer 36 may contain signal paths such as metal traces that form or that couple to contact pads such as pads 40. Pads 40 may be formed on the upper surface of interposer 36, on the lower surface of interposer 36, or on the sides of interposer 36. Conductive material 82 (e.g., solder, conductive adhesive, or other conductive connections) may be used in coupling pads 40 to conductive strand 80C.

If desired, component 26 may include a protective structure such as protective structure 130 on interposer 36. Protective structure 130 may, for example, be a plastic structure that completely or partially encapsulates devices 28 and interposer 36 to provide mechanical robustness, protection from moisture and other environmental contaminants, heat sinking, and/or electrical insulation. Protective structure 130 may be formed from molded plastic (e.g., injection-molded plastic, transfer molded plastic, low-pressure molded plastic, two-part molded plastic, etc.) that has been molded over devices 28 and interposer 36 or that is pre-formed into the desired shape and subsequently attached to interposer 36, may be a layer of encapsulant material (e.g., thermoplastic) that has been melted to encapsulate devices 28, may be a layer of polymer such as polyimide that has been cut or machined into the desired shape and subsequently attached to interposer 36, or may be formed using other suitable methods. Illustrative materials that may be used to form protective structure 130 include epoxy, polyamide, polyurethane, silicone, other suitable materials, or a combination of any two or more of these materials. Protective structure 130 may be formed on one or both sides of interposer 36 (e.g., may completely or partially surround interposer 36).

Protective structure 130 may be entirely opaque, may be entirely transparent, or may have both opaque and transparent regions. Transparent portions of protective structure 130 may allow light emitted from one or more devices 28 to be transmitted through protective structure 130 and/or may allow external light to reach (and be detected by) one or more devices 28. In some arrangements, protective structure 130 may be an encapsulant material such as thermoplastic that has been melted to create a robust connection between component 26 and strands 80 of fabric 12. For example, protective structure 130 may surround portions of strands 80, may fill recesses, grooves, or other features in component 26 to help interlock component 26 to strands 80, and/or may fill gaps in fabric 12.

If desired, interposer 36 may be sufficiently large to accommodate multiple electrical devices each with a respective body 28. For example, one or more light-emitting diodes, sensors, microprocessors, and/or other electrical devices may be mounted to a common interposer such as interposer 36. The light-emitting diodes may be micro-light-emitting diodes (e.g., light-emitting diode semiconductor dies having footprints of about 10 microns×10 microns, more than 5 microns×5 microns, less than 100 microns×100 microns, or other suitable sizes). The light-emitting diodes may include light-emitting diodes of different colors (e.g., red, green, blue, white, etc.), infrared light, or ultraviolet light. Redundant light-emitting diodes or other redundant circuitry may be included on interposer 36. Electrical component 26 may include any suitable combination of electrical devices (e.g., light-emitting diodes, sensors, integrated circuits, actuators, and/or other devices).

The example of FIG. 2 in which devices 28 are only located on one side of interposer 36 are merely illustrative. If desired, devices 28 may be mounted to both sides of interposer 36.

Electrical components 26 may be coupled to fabric structures, individual strands, printed circuits (e.g., rigid printed circuits formed from fiberglass-filled epoxy or other rigid printed circuit board material or flexible printed circuits formed from polyimide substrate layers or other sheets of flexible polymer materials), metal or plastic parts with signal traces, or other structures in item 10.

As shown in FIG. 2, component 26 may be coupled to conductive strands 80C of fabric 12. Conductive strands 80C (sometimes referred to as "wires") may be configured to carry electrical signals (e.g., power, digital signals, analog signals, sensor signals, control signals, data, input signals, output signals, or other suitable electrical current) to and/or from components 26. Strands 80C may be warp strands (e.g., warp strands 20), weft strands (e.g., weft strands 22), or other suitable strands 80 in fabric 12 (e.g., knitted strands, braided strands, inlaid or inserted strands, etc.). If desired, component 26 may be coupled to only a single conductive strand 80C, may be coupled to two conductive strands 80C, or may be coupled to three or more conductive strands 80C. Arrangements in which component 26 is coupled to a pair of conductive strands 80C are sometimes described herein as an illustrative example.

To increase the robustness of the connection between strands 80C and component 26, component 26 may have one or more recesses for receiving strands 80C. For example, strands 80C may each be threaded through a portion of component 26 to help secure component 26 to fabric 12. Strands 80 may be threaded through recesses, openings, trenches, grooves, holes, and/or other engagement features of component 26. The recesses, openings, trenches, grooves, holes, or other engagement features may be formed in device 28, interposer 36, protective structure 130, and/or other portions of component 26. As shown in FIG. 2, conductive strands 80C are received within grooves such as grooves 50 that are formed in protective structure 130. This is, however, merely illustrative. If desired, grooves 50 may instead or additionally be formed in interposer 36, device 28, and/or other portions of component 26. The location, shape, and geometry of grooves 50 of FIG. 2 are merely illustrative.

Grooves 50 (sometimes referred to as trenches, openings, notches, recesses, etc.) in protective structure 130 may be formed by removing portions of protective structure 130 (e.g., using a laser, a mechanical saw, a mechanical mill, or other equipment) or may be formed by molding (e.g., injection molding) or otherwise forming protective structure 130 into a shape that includes grooves 50. Grooves 50 may have a width between 2 mm and 6 mm, between 0.3 mm and 1.5 mm, between 1 mm and 5 mm, between 3 mm and 8 mm, greater than 3 mm, less than 3 mm, or other suitable width. If desired, trenches 50 may have different depths (e.g., to expose contact pads 40 that are located at different surface heights of interposer 36).

Grooves 50 may expose conductive pads 40 on interposer 36. Strands 80C may each be threaded through an associated one of grooves 50 in protective structure 130. Solder or other conductive material 82 may be used to electrically and mechanically couple strands 80C to conductive pads 40 in grooves 50 of protective cover 130. Because strands 80C are wedged between portions of protective cover 130, strands 80C may be resistant to becoming dislodged from interposer 36. In addition to holding strands 80C in place so that component 26 remains attached to fabric 12, grooves 50 may also be used as a physical guide for aligning component 26 relative to fabric 12 during component attachment operations. This is merely illustrative, however. If desired, component 26 may be free of grooves.

Encapsulant material 260 (e.g., thermoplastic, epoxy, polyamide, polyurethane, silicone, other suitable materials, or a combination of any two or more of these materials) may encapsulate the solder connection between component 26 and conductive strands 80C. Encapsulant material 260 may be a part of protective structure 130 that is melted to cover the solder connection in each groove 50, or encapsulant material 260 may be a separate encapsulant material that is dispensed in each groove 50. In some arrangements, encapsulant material 260 may be formed from a dual-phase solder material (e.g., a solder material that releases encapsulation material during the soldering process). If desired, component 26 may include both encapsulant that is dispensed in grooves 50 (e.g., on an upper and/or lower side of component 26) as well as thermoplastic that is melted (e.g., on an upper and/or lower side of component 26) to help secure component 26 to fabric 12.

Using weaving equipment, strands 80 may be woven to form fabric 12. The weaving equipment may create one or more regions in fabric 12 such as pocket 66 (sometimes referred to as a gap, space, cavity, void, position, location, etc.) for receiving electrical components such as component 26. Regions in fabric 12 that receive electrical components such as pocket 66 may be formed by creating a space or gap between portions of fabric 12 such as fabric portion 12-1 and fabric portion 12-2. The term "pocket" may be used to refer to a void between fabric portions and/or may be used to refer to a position or location between fabric portions (e.g., a position between strands of material in fabric 12).

Electrical components such as electrical component 26 may be inserted into pocket 66 during the formation of fabric 12. If desired, component 26 may be electrically and mechanically connected to one or more conductive strands 80C in pocket 66. Following insertion of component 26, the weaving equipment may continue weaving operations (which may include closing pocket 66, if desired) to continue forming fabric 12.

In some arrangements, processing steps such as alignment of component 26 with conductive strands 80C, electrically connecting (e.g., soldering) component 26 to conductive strands 80C, encapsulation of the electrical connection between component 26 and conductive strands 80C, and/or verification of the integrity of the electrical connection between component 26 and conductive strands 80C may be performed before conductive strands 80C and component 26 are incorporated into fabric 12.

After electrical component 26 is mechanically and electrically connected to conductive strand 80C, conductive strand 80C may be fed through a feeder (sometimes referred to as a component detector) that provides conductive strand 80C to the weaving equipment. The feeder may have one or more sensors that detects when electrical component 26 on conductive strand 80C reaches the feeder. In response to detecting the component, one or more components of the weaving system may be adjusted in preparation for receiving electrical component 26. This may include changing the fabric construction of fabric 12 in response to detecting the component so that a component receiving area can be created in the fabric at the location where component 26 will be placed.

As shown in FIG. 2, for example, fabric 12 may have component receiving regions 32 and component-free regions 34 (sometimes referred to as pocket-free regions). The weaving equipment may weave fabric 12 with a first construction in regions 34. For example, regions 34 may not include pockets (e.g., outer fabric portions 12-1 and 12-2 may be connected with a greater density of connecting strands 80). When the component detector detects component 26, the weaving equipment may adjust weaving components to create component receiving region 32 (e.g., to create pocket 66 between outer fabric portions 12-1 and 12-2). This ensures that component 26 is placed in the appropriate location within fabric 12 automatically and on-the-fly. The weaving equipment may return to normal weaving operations to form regions 34 on opposing sides of component receiving region 32.

In some arrangements, the gap between first and second fabric portions 12-1 and 12-2 may remain in place after electrical component 26 is enclosed in fabric 12 (e.g., a space may exist between fabric portions 12-1 and 12-2 after formation of fabric 12 is complete). In other arrangements, first and second fabric portions 12-1 and 12-2 may be pulled together such that gap 66 is eliminated after electrical component 26 is enclosed in the gap (e.g., fabric portions 12-1 and 12-2 may be in contact with one another without an intervening gap after the formation of fabric 12 is complete). Fabric 12 may have a bulge where electrical component 26 is located, or fabric 12 may not have a bulge where electrical component 26 is located (e.g., the fabric may have substantially uniform thickness across locations with electrical components 26 and locations without electrical components 26, if desired).

Figure 3:
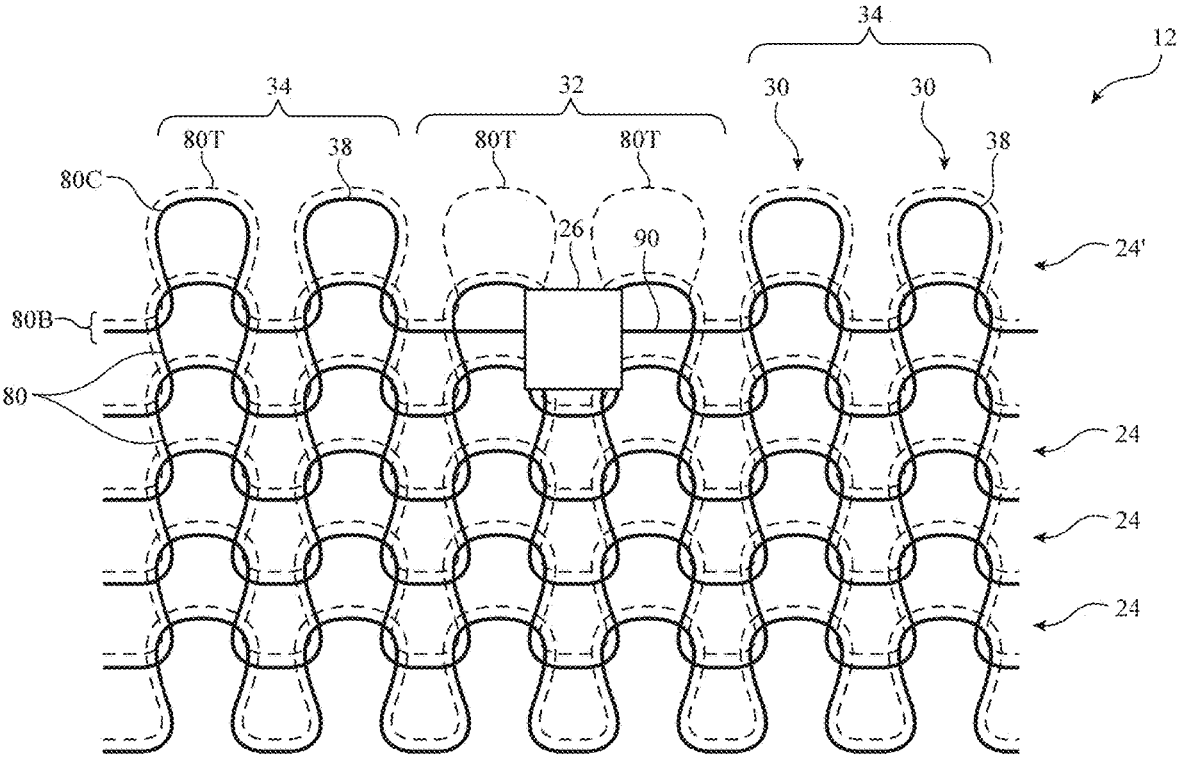
FIG. 3 is a side view of illustrative knit fabric to which an electrical component has been mounted in accordance with an embodiment.

If desired, components such as electrical component 26 of FIG. 2 may be incorporated into knit fabrics. An illustrative knit fabric is shown in FIG. 3. In the illustrative configuration of FIG. 3, fabric 12 has a single layer of weft knit strands 80. Other fabric constructions may be used for fabric 12 if desired. For example, fabric 12 may include multiple layers of weft knit fabric (e.g., to form a double knit fabric), may include warp knit fabric, spacer fabric, circular knit fabric, and/or any other suitable type of knit fabric.

As shown in FIG. 3, fabric 12 may include strands 80 or other strands of material that form horizontally extending rows (courses 24) of interlocking loops 38 and vertically extending wales 30. Some or all of strands 80 in fabric 12 such as strand 80C in course 24' in the example of FIG. 3 may be conductive.

Some or all of the conductive strands in fabric 12 may be provided with electrical components such as illustrative component 26. Components in fabric 12 such as component 26 may be light-based components (e.g., light-emitting diodes and/or light detectors), may be sensors that sense temperature, pressure, force, capacitance, touch, magnetic field strength, motion, other suitable sensors, integrated circuits with sensors and/or light-based components, integrated circuits with communications circuitry and/or control circuitry, and/or other electrical devices. Component 26 may have a structure of the type shown and described in connection with component 26 of FIG. 2, or component 26 may have a different structure than that of FIG. 2.

Components such as component 26 may be mounted to loops 38 (e.g., knit stitches, tuck stitches, or other suitable loops 38), or component 26 may be mounted to floats such as float 90 in fabric 12.

In some arrangements, processing steps such as alignment of component 26 with conductive strands 80C, electrically connecting (e.g., soldering) component 26 to conductive strands 80C, encapsulation of the electrical connection between component 26 and conductive strands 80C, and/or verification of the integrity of the electrical connection between component 26 and conductive strands 80C may be performed before conductive strands 80C and component 26 are incorporated into fabric 12.

After electrical component 26 is mechanically and electrically connected to conductive strand 80C, conductive strand 80C may be fed through a feeder (e.g., component detector) that provides conductive strand 80C to the knitting equipment that forms fabric 12. The feeder may have one or more sensors that detects when electrical component 26 on conductive strand 80C reaches the feeder. In response to detecting component 26, one or more members of the knitting system may be adjusted in preparation for receiving electrical component 26. This may include changing the fabric construction of fabric 12 in response to detecting component 26 so that a component receiving area can be created in the fabric at the location where component 26 will be placed.

As shown in FIG. 3, for example, fabric 12 may have component receiving regions 32 and component-free regions 34. The knitting equipment may knit fabric 12 with a first construction in regions 34. For example, regions 34 may not include pockets (e.g., gaps between a first knit fabric layer and an outer knit fabric layer of the type shown in FIG. 3), may include greater density of strands 80 than regions 32, and/or may include more knit stitches such as loops 38 than regions 32. When the component detector detects component 26, the knitting equipment may adjust knitting components to create component receiving region 32 (e.g., to create pocket 66 between outer knit fabric layers and/or to create one or more floats such as float 90). This ensures that component 26 is placed in the appropriate location within fabric 12 automatically. The knitting equipment may return to normal knitting operations to form regions 34 on opposing sides of component receiving region 32.

If desired, conductive strands 80C may be bundled with non-conductive (e.g., insulating) strands that are controlled by different feeders. As shown in FIG. 3, for example, strands 80 may include bundled strands 80B. Each bundle 80B may include conductive strand 80C and non-conductive (e.g., insulating) strand 80T. A plating process in which the position of each of the strands in bundle 80B is independently controlled by a respective feeder may be used. For example, when it is desired to mount component 26 to conductive strand 80C, a first feeder may move conductive strand 80C back (e.g., away from the needles holding loops 38) while the second feeder forms front-side loops 38 with non-conductive strand 80T without conductive strand 80C. The first feeder may then reengage to return conductive strand 80C to bundle 80B and knitting may continue by forming loops 38 with conductive strand 80C and non-conductive strand 80B. This helps isolate conductive strand 80C away from bundle 80B in region 32 so that component 26 can be mounted to conductive strand 80C in region 32. Additionally, non-conductive strand 80T may form a jersey knit or other flat knit layer on the front side of fabric 12 that covers component 26 to hide component 26 and conductive strand 80C from view on the front side of fabric 12.

Figure 4:
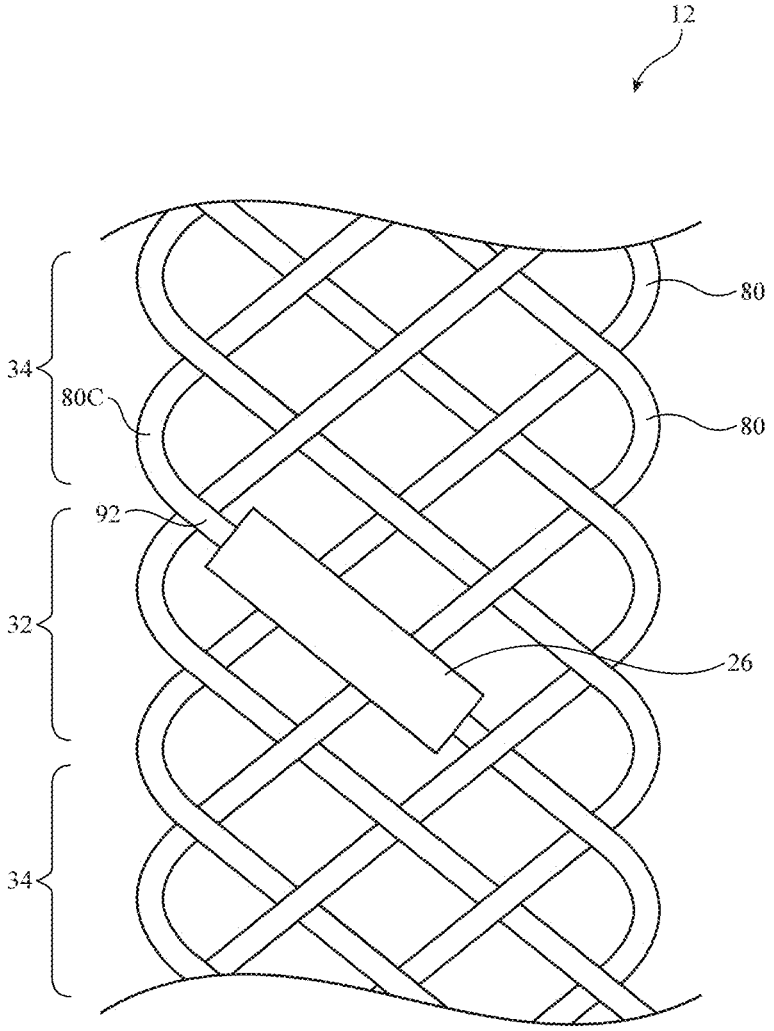
FIG. 4 is a braided fabric to which an electrical component has been mounted in accordance with an embodiment.

If desired, components such as electrical component 26 of FIG. 2 may be incorporated into braided fabrics. An illustrative braided fabric is shown in FIG. 4. In the illustrative configuration of FIG. 4, fabric 12 includes braided strands 80. Some or all of strands 80 in fabric 12 such as strand 80C may be conductive.

Some or all of the conductive strands in fabric 12 may be provided with electrical components such as illustrative component 26. Components in fabric 12 such as component 26 may be light-based components (e.g., light-emitting diodes and/or light detectors), may be sensors that sense temperature, pressure, force, capacitance, touch, magnetic field strength, motion, other suitable sensors, integrated circuits with sensors and/or light-based components, integrated circuits with communications circuitry and/or control circuitry, and/or other electrical devices. Component 26 may have a structure of the type shown and described in connection with component 26 of FIG. 2, or component 26 may have a different structure than that of FIG. 2.

If desired, components such as component 26 may be mounted to a float in conductive strand 80C such as float 92 that passes over two or more other braided strands 80 to accommodate component 26.

In some arrangements, processing steps such as alignment of component 26 with conductive strands 80C, electrically connecting (e.g., soldering) component 26 to conductive strands 80C, encapsulation of the electrical connection between component 26 and conductive strands 80C, and/or verification of the integrity of the electrical connection between component 26 and conductive strands 80C may be performed before conductive strands 80C and component 26 are incorporated into fabric 12.

After electrical component 26 is mechanically and electrically connected to conductive strand 80C, conductive strand 80C may be fed through a feeder that provides conductive strand 80C to the braiding equipment that forms fabric 12. The feeder may have one or more sensors that detects when electrical component 26 on conductive strand 80C reaches the feeder. In response to detecting component 26, one or more members of the braiding system may be adjusted in preparation for receiving electrical component 26. This may include changing the fabric construction of fabric 12 in response to detecting component 26 so that a component receiving area can be created in the fabric at the location where component 26 will be placed.

As shown in FIG. 4, for example, fabric 12 may have component receiving regions 32 and component-free regions 34. The braiding equipment may braid fabric 12 with a first construction in regions 34. For example, regions 34 may include braided strands that do not include any floats. When the component detector detects component 26, the braiding equipment may adjust braiding components to create component receiving region 32 (e.g., to create one or more floats such as float 92). This ensures that component 26 is placed in the appropriate location within fabric 12 automatically. The braiding equipment may return to normal braiding operations to form regions 34 on opposing sides of component receiving region 32.

Figure 5:
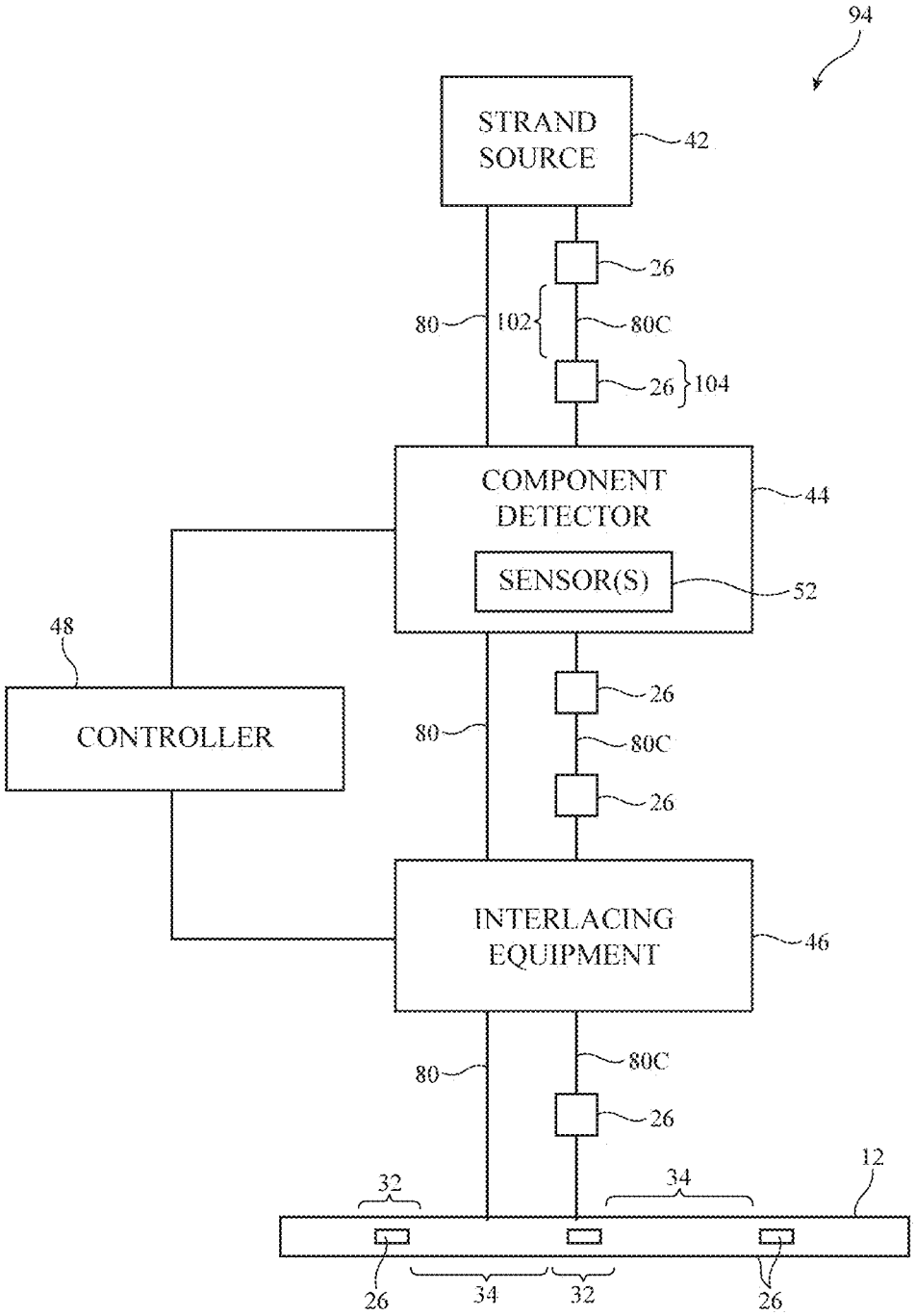
FIG. 5 is a diagram of illustrative equipment that may be used to insert electrical components into fabric during formation of the fabric in accordance with an embodiment.

Illustrative equipment for inserting electrical components into fabric during formation of the fabric is shown in FIG. 5. As shown in FIG. 5, equipment 94 may include strand source 42. Strand source 42 may supply strands 80 from a beam, a creel, cones, a bobbin, or other strand dispensing structure. Source 42 may, for example, dispense strands 80 through electrically controlled dispensing rollers or other strand dispensing and tensioning equipment (e.g., a rotating drum, electrically controlled actuators, sensors, and/or other equipment that measures, controls, and/or adjusts strand feed and tension of strands 80).

Strand source 42 may dispense strands 80 that include non-conductive strands and conductive strands 80C. Conductive strands 80C and non-conductive strands 80 may be dispensed from separate structures in source 42 or may be dispensed from a common structure.

One or more electrical components 26 may be mounted to conductive strand 80C. Component 26 may have a structure of the type shown and described in connection with component 26 of FIG. 2, or component 26 may have a different structure than that of FIG. 2. For example component 26 may have one or more grooves 50 that receive conductive strand 80C. Conductive strand 80C may be electrically and mechanically coupled to conductive strand 80C using solder or other conductive material. The conductive material may be located in groove 50 and encapsulated with encapsulant material, if desired.

Controller 48 may control the operation of equipment 94. Controller 48 may include storage and processing circuitry for implementing control functions during interlacing operations (e.g., weaving, braiding, knitting, etc.). The storage may include, for example, random-access memory, non-volatile memory such as read-only memory, hard disk storage, etc. The processing circuitry may include microprocessors, microcontrollers, digital signal processors, application-specific integrated circuits, and other circuits for executing software instructions obtained from storage.

Controller 48 may be configured to control the operation of interlacing equipment 46. Interlacing equipment 46 may include weaving equipment (e.g., weaving equipment 98 of FIG. 10 or other suitable weaving equipment), knitting equipment (e.g., knitting equipment 96 of FIG. 9 or other suitable knitting equipment), braiding equipment (e.g., braiding equipment 100 of FIG. 11 or other suitable braiding equipment), and/or other suitable interlacing equipment for forming fabric.

Strands 80 from source 42 including conductive strands 80C may be fed to interlacing equipment 46 through component detector 44 (sometimes referred to as feeder 44). If desired, only conductive strands 80C may be fed through component detector 44 and non-conductive strands 80 may be fed directly to interlacing equipment 46 without passing through component detector 44). In other arrangements, both conductive strands 80C and non-conductive strands 80 may be fed to interlacing equipment 46 through component detector 44. Component detector 44 may be integrated with one or more of the existing components of interlacing equipment 46, or component detector 44 may be a dedicated component detector that feeds strands 80 to interlacing equipment 46.

Component detector 44 may include one or more sensors such as sensors 52. Sensors 52 may be configured to detect the presence of component 26 when it reaches component detector 44. Sensors 52 may include strain gauge sensors, proximity sensors, ambient light sensors, touch sensors, force sensors, temperature sensors, pressure sensors, magnetic sensors, accelerometers, gyroscopes and other sensors for measuring orientation (e.g., position sensors, orientation sensors), microelectromechanical systems sensors, and other sensors. Proximity sensors in sensors 52 may emit and/or detect light and/or may be capacitive proximity sensors that generate proximity output data based on measurements by capacitance sensors (as examples). Proximity sensors may be used to detect the presence of component 26 in, on, or near component detector 44).

As conductive strand 80C is fed through component detector 44, sensors 52 may gather sensor data indicating whether or not component 26 is present in, on, or near component detector 44. Controller 48 may be configured to control interlacing equipment 46 based on the sensor data from sensors 52 of component detector 44. If, for example, the portion of conductive strand 80C in component detector 44 does not include any electrical components 26 (such as segment 102 of FIG. 5), sensor data from sensors 52 may indicate that no electrical component 26 is present in component detector 44. In response to this sensor data, controller 48 may control interlacing equipment 46 to form component-free regions 34 in fabric 12 (e.g., component-free regions 34 of FIG. 2, 3, or 4). For example, if interlacing equipment 46 is weaving equipment, strands 80 may be woven normally (e.g., without floats) and/or outer woven layers may be connected with a connecting strand and/or a higher density of connecting strands (e.g., to form a pocket-free region). If interlacing equipment 46 is knitting equipment, strands 80 may be knit normally (e.g., knit loops 38 may be formed instead of floats 90) and/or outer knit layers may be connected with a connecting strand and/or a higher density of connecting strands (e.g., to form a pocket-free region). If interlacing equipment 46 is braiding equipment, strands 80 may be braided normally (e.g., without floats 92). These examples are merely illustrative. If desired, fabric 12 may have other constructions in component-free regions 34.

When the portion of conductive strand 80C in component detector 44 includes electrical component 26 (such as segment 104 of FIG. 5), sensor data from sensors 52 may indicate electrical component 26 is present. In response to this sensor data from sensors 52, controller 48 may control interlacing equipment 46 to form component-receiving regions 32 in fabric 12 (e.g., component-receiving regions 32 of FIG. 2, 3, or 4). For example, if interlacing equipment 46 is weaving equipment, strands 80 may be woven with floats and/or a void such as pocket 66 may be created between outer woven layers. If interlacing equipment 46 is knitting equipment, strands 80 may be knit to include one or more floats 90 and/or a void such as a pocket may be created between outer knit layers. If interlacing equipment 46 is braiding equipment, strands 80 may be braided to form floats 92. These examples are merely illustrative. If desired, fabric 12 may have other constructions in component-receiving regions 32.

Figure 6:
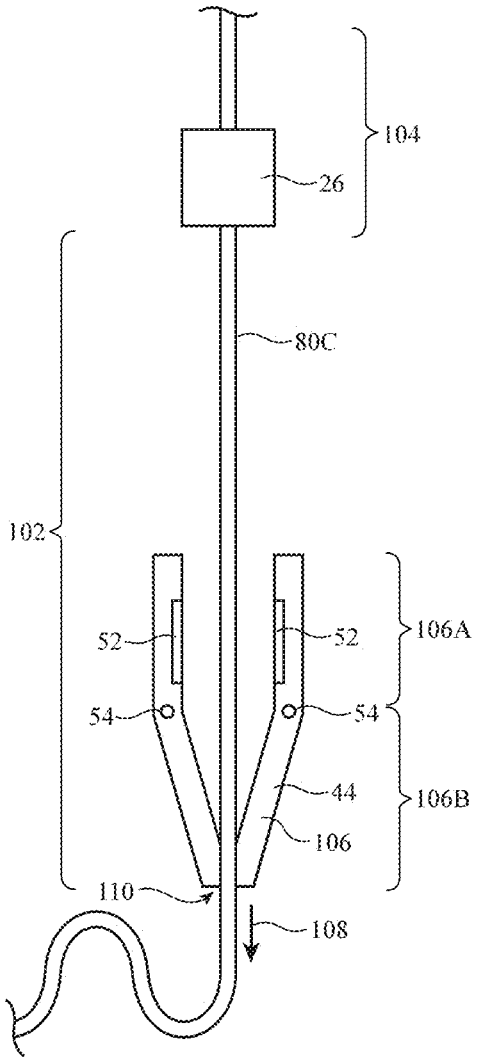
FIG. 6 is a front view of an illustrative component detector receiving a conductive strand to which an electrical component has been mounted in accordance with an embodiment.

FIG. 6 is a front view of component detector 44 receiving and feeding a conductive strand such as conductive strand 80C. Component detector 44 may receive strands 80 such as conductive strand 80C from strand source 42 (FIG. 5). As shown in FIG. 6, component detector 44 may include first and second arms such as arms 106. Arms 106 may be separated by an opening such as gap 110 through which conductive strand 80C passes as it is fed from strand source 42 to interlacing equipment 46 (e.g., weaving equipment, knitting equipment, braiding equipment, and/or other suitable interlacing equipment) in direction 108.

Component detector 44 may include one or more movable portions. For example, arms 106 of component detector 44 may each include first and second arm members 106A and 106B that are movable relative to one another. Arm member 106B may be configured to rotate relative to arm member 106A about rotational axis 54. This allows the size of the gap between arm members 106 to be adjusted as conductive strand 80C passes through component detector 44 in direction 108. Movement of arm members 106 to adjust the size of opening 110 through which conductive strand 80C passes may be controlled mechanically (e.g., when component 26 reaches arms 106 the component 26 may push open arms 106, or some other mechanical actuator may open arms 106 when component 26 arrives to detector 44) or may be controlled electrically in response to control signals from controller 48.

As conductive strand 80C passes through detector 44 in direction 108, sensors 52 may gather sensor data to determine whether the segment of conductive strand 80C that is within detector 44 (e.g., between arms 106) includes an electrical component such as component 26. In the example of FIG. 6, segment 104 of conductive strand 80C with component 26 has not yet reached detector 44. Sensors 52 may detect strand segment 102, which does not include any electrical components. In response to sensor data from sensors 52 indicating that electrical component 26 is not present in component detector 44 (e.g., component 26 is not present between arms 106), controller 48 may control interlacing equipment 46 to form fabric 12 with component-free regions 34. In arrangements where controller 48 controls movement of arms 106, controller 48 may keep arms 106 relatively narrow in response to sensor data from sensors 52 indicating that segment 102 does not include any electrical components while still allowing segment 102 to pass through opening 110.

Figure 7:
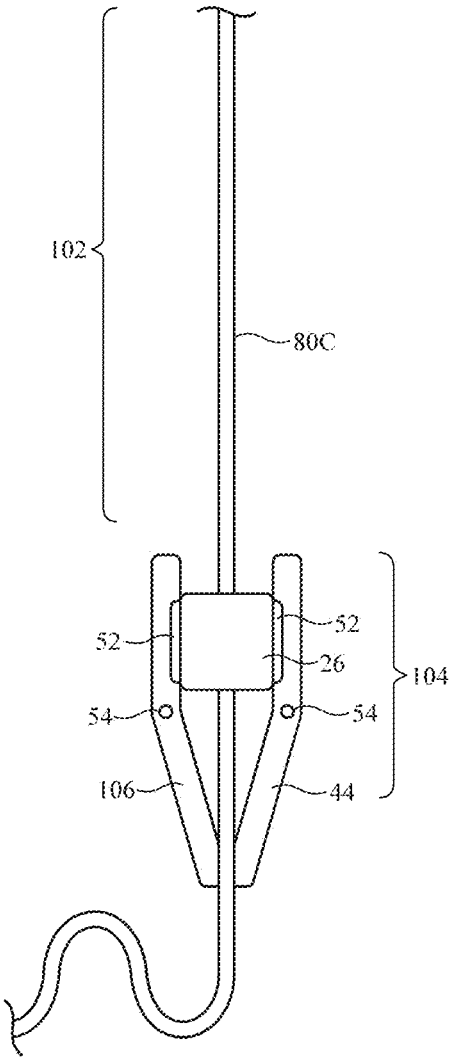
FIG. 7 is a front view of an illustrative component detector detecting an electrical component on a conductive strand before the electrical component is incorporated into fabric in accordance with an embodiment.

In the example of FIG. 7, segment 104 of conductive strand 80C which includes component 26 has reached detector 44. Sensors 52 may detect electrical component 26 on segment 104. In response to sensor data from sensors 52 indicating that electrical component 26 is present in component detector 44 (e.g., that component 26 is present between arms 106), controller 48 may control interlacing equipment 46 to form fabric 12 with component-receiving regions 32. This allows interlacing equipment 46 to adjust components in the weaving system, knitting system, braiding system, or other system in preparation for receiving electrical component 26 (e.g., by moving warp strands or warp strand positioners out of the way, by moving needles or guide bars out of the way, by moving braiding carriers out of the way, by creating a different fabric construction such as pockets, floats, or other fabric structures that will receive electrical component 26, etc.).

Figure 8:
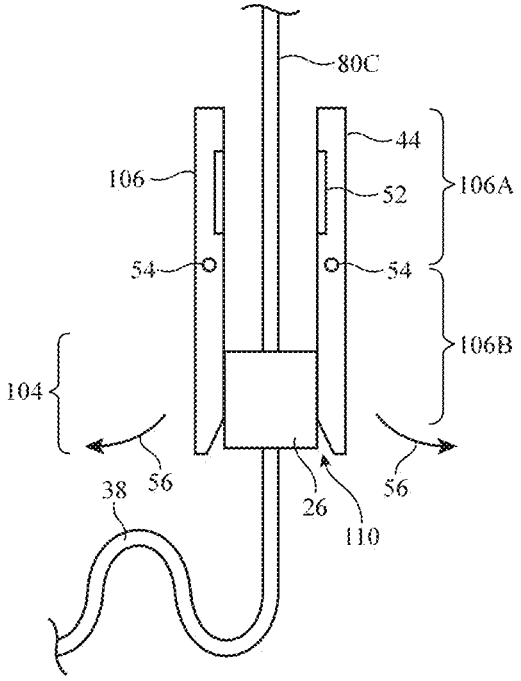
FIG. 8 is a front view of an illustrative component detector feeding a conductive strand and electrical component to interlacing equipment that incorporates the conductive strand and electrical component into fabric in accordance with an embodiment.

In response to detecting component 26 with component detector 44, arms 106 may be opened to the position of FIG. 8 to allow component 26 to pass through detector 44. As shown in FIG. 8, arm members 106B may rotate in directions 56 relative to arm members 106A about respective rotational axes 54. The rotation of arms 106 may be mechanically actuated by the arrival of component 26 in detector 44, or the rotation of arms 106 may be electrically actuated by controller 48 in response to sensor data from sensors 52. This allows component 26 to pass through opening 110 so that segment 104 of conductive strand 80C can be incorporated into fabric 12 while ensuring that component 26 is received in the appropriate portion of fabric 12 (e.g., component receiving portions 32).

Figure 9:
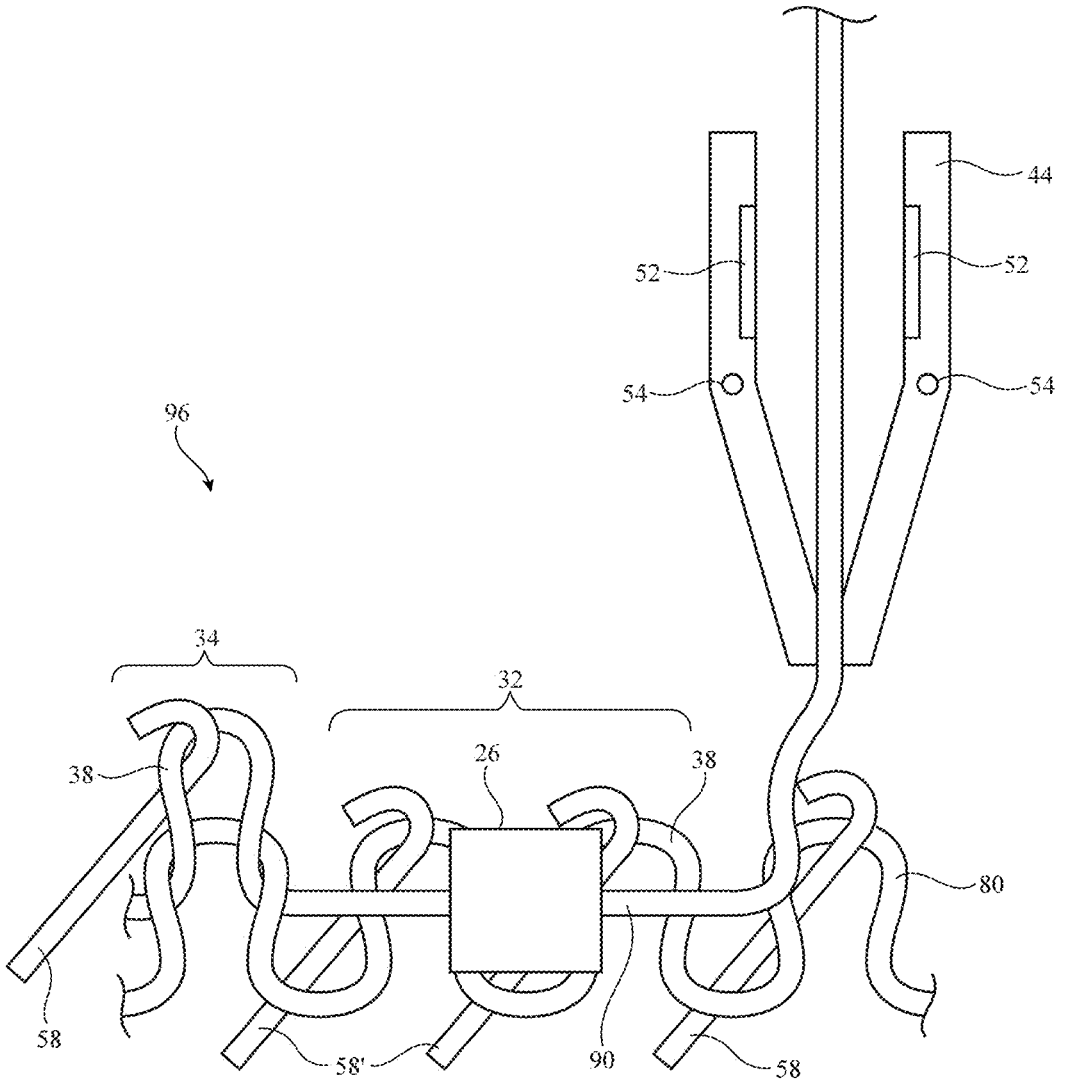
FIG. 9 is a front view of illustrative knitting equipment having members that are adjusted to accommodate an electrical component in response to detecting the electrical component with a component detector in accordance with an embodiment.

FIG. 9 is a front view of illustrative interlacing equipment 46 such as knitting equipment 96 receiving strand 80C from component detector 44. Knitting equipment 96 may include strand guide structures such as feeders that guide strands 80 towards needles such as needles 58. Needles 58 may include latch needles or needles of other types. In some arrangements, equipment 96 may include multiple beds of needles 58 such as a front needle bed and a back needle bed. Equipment 96 may include strand positioning structures that move strands 80 from one needle bed to another needle bed. Equipment 96 may also include hooks or other cam structures and other structures for manipulating the positions of needles 58. The needles, feeders, and other knitting elements in equipment 96 may be implemented as separately adjustable components or the functionality of two or more of these tools may be combined in equipment 96.

Knitting elements 96 may be used to knit strands 80 into knitted fabric 12 (e.g., a weft knit fabric of the type shown in FIG. 3, a warp knit fabric, a circular knit fabric, a double knit fabric, a spacer knit fabric, and/or other suitable knit fabric 12). Knitted fabric 12 may be gathered on drums or other take-down equipment. If desired, take-down equipment may have multiple independently controlled rollers so that components 26 are not damaged or dislodged by the take-down equipment.

In response to information from component detector 44 indicating that component 26 has reached component detector 44 (e.g., in response to sensor data from sensors 52 in detector 44), controller 48 may be configured to adjust one or more components of knitting system 96 to accommodate component insertion. For example, as shown in FIG. 9, needles 58' may be lowered relative to other needles 58 so that needles 58' do not interfere with component insertion. This also allows conductive strand 80C to form float 90 where conductive strand 80C does not form knit stitches 38 with other strands 80 in fabric 12. Float 90 may pass over one, two, three, or more than three loops 38 of fabric 12.

The needles 58' that are selected to be lowered relative to other needles 58 may be based on the timing at which component 26 is expected to reach component-receiving region 32. The timing may be based on the length of strand 80C between component detector 44 and component-receiving region 32, for example.

Component detector 44 may be integrated with one or more of the existing components of knitting equipment 96 (e.g., guide bars, feeders, needles, strand dispensing equipment, etc.), or component detector 44 may be a dedicated component detector that feeds strands 80 to knitting equipment 96.

Figure 10:
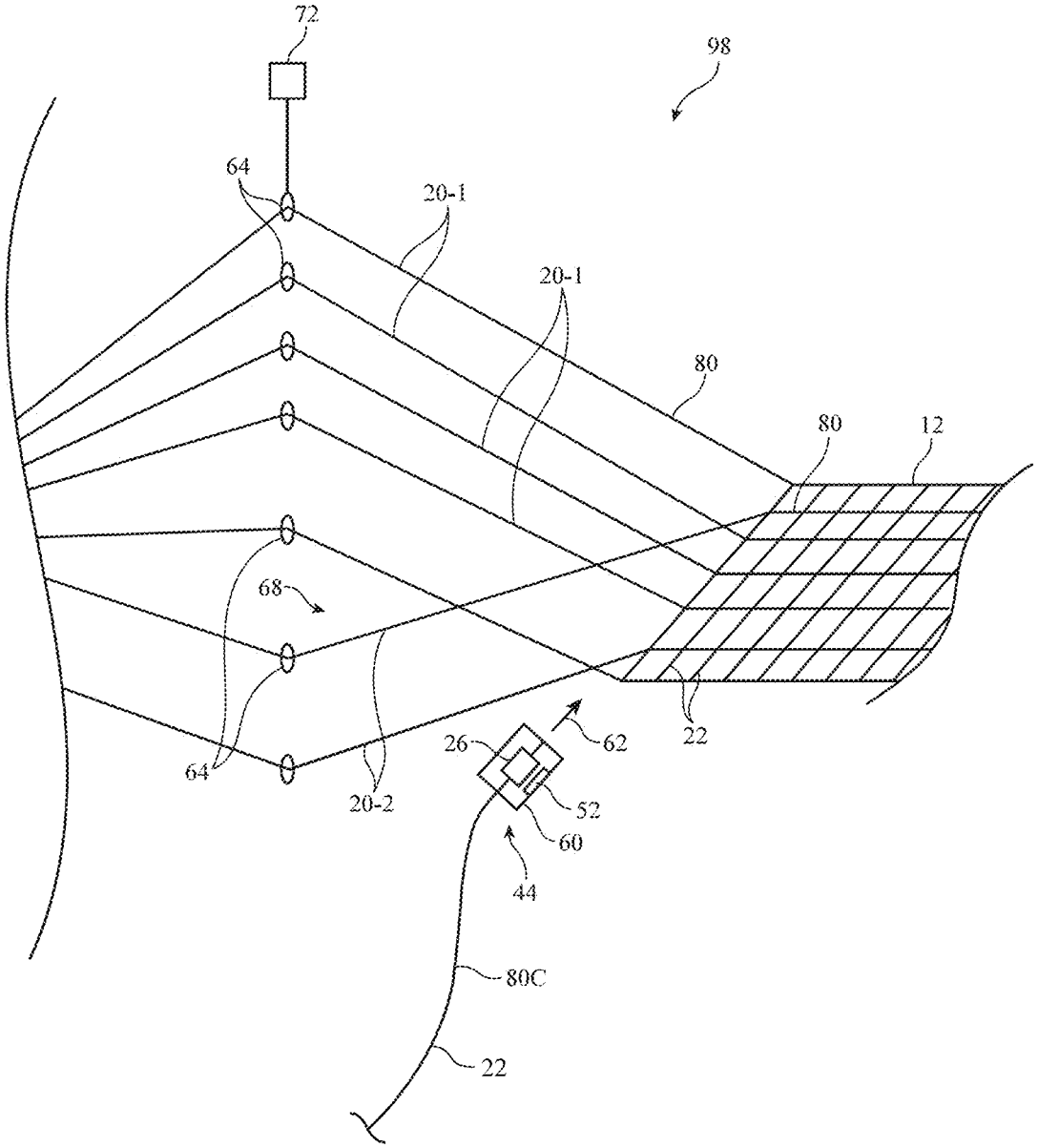
FIG. 10 is a perspective view of illustrative weaving equipment having members that are adjusted to accommodate an electrical component in response to detecting the electrical component with a component detector in accordance with an embodiment.

FIG. 10 is a front view of illustrative interlacing equipment 46 such as weaving equipment 98 receiving strand 80C from component detector 44. Weaving equipment 98 may be used to weave strands 80 such as warp strands 20 and weft strands 22. Warp strands 20 may be positioned using warp strand positioning equipment such as heddles 64. Heddles 64 may each include an eye mounted on a wire or other support structure that extends between respective positioners 72 (or between a positioner and an associated spring or other tensioner). In some arrangements, heddles 64 may be mechanically driven (e.g., by a dobby). In other arrangements, positioners 72 that move heddles 64 may be motors (e.g., stepper motors) or other electromechanical actuators that are controlled by controller 48 during weaving operations so that warp strands 20 are placed in desired positions during weaving. In particular, controller 48 may supply control signals that move each heddle 64 by a desired amount up or down. By raising and lowering heddles 64 in various patterns (e.g., to different heights) in response to control signals from controller 48, different patterns of sheds 68 (gaps) between warp strands 20 may be created to adjust the characteristics of the fabric produced by equipment 98.

Weft strands 22 may be inserted into one or more sheds 68 during weaving to form woven fabric 12 (e.g., woven fabric 12 of FIG. 2 or other suitable woven fabric). Weft strand positioning equipment 60 may be used to place one or more weft strands 22 between the warp strands 20 forming each shed 68. Weft strand positioning equipment 60 for equipment 98 may include one or more shuttles and/or may include shuttleless weft strand positioning equipment (e.g., needle weft strand positioning equipment, rapier weft strand positioning equipment, or other weft strand positioning equipment such as equipment based on projectiles, air or water jets, etc.). For example, weft strand positioning equipment 60 of equipment 98 may include an electrically controllable rapier weft strand device or other weft strand insertion equipment that is controlled by controller 48. Weft strand positioning equipment 60 may, if desired, be controlled independently of other components in equipment 98. For example, weft strand insertion operations may be temporarily suspended with or without suspending other weaving operations.

Weft strand positioning equipment 60 may insert weft strand 22 into shed 68 across fabric 12 and may, if desired, attach weft strand 22 to a binder on an opposing side of fabric 12 (e.g., a strand that stitches the edges of fabric 12). After each pass of weft strand 22 is made through shed 68, a reed (e.g., a reed member with slots or other openings through which respective warp strands 20 pass, not shown in FIG. 10) may be moved towards fabric 12 to push the weft strand 22 that has just been inserted into shed 68 between respective warp strands 20 against previously woven fabric 12, thereby ensuring that a satisfactorily tight weave is produced. Reed movement may be linear movement or may be rotational movement back and forth about a shaft to approximate linear reciprocating movement. The positioner for the reed may be, for example, a linear actuator that is controlled by control signals from controller 48 and that moves the reed towards and away from the edge of fabric 12.

Fabric 12 that has been woven may be gathered on fabric collection equipment such as take-down rollers or other take-down equipment. If desired, take-down equipment may include multiple independently controlled rollers, which may help protect electrical components in fabric 12 while maintaining an appropriate amount of tension in fabric 12. For example, less tension may be applied to portions 32 of fabric 12 where electrical components 26 are located, while other portions 34 of fabric 12 that do not include electrical components may be held under a higher amount of tension.

In some arrangements, a component detector 44 of the type described in connection with FIGS. 5, 6, 7, and 8 may feed conductive strand 80C to weaving equipment 98. For example, component detector 44 may feed conductive strand 80C to warp strand positioning equipment 64 or may feed conductive strand 80C to weft strand positioning equipment 60. In some arrangements, component detector 44 may be integrated with one or more of the components of weaving equipment 98 such as warp strand positioning equipment 64 or weft strand positioning equipment 60. In the example of FIG. 10, component detector 44 is integrated with weft positioning equipment 60. For example, weft positioning equipment 60 may be a shuttle that includes sensors 52 for detecting component 26 on conductive strand 80C.

In response to information from component detector 44 indicating that component 26 has reached component detector 44 (e.g., in response to sensor data from sensors 52 in detector 44), controller 48 may be configured to adjust one or more components of weaving system 98 to accommodate component insertion. For example, as shown in FIG. 10, warp strand positioners 64 may raise warp strands 20-1 and may lower warp strands 20-2 to create shed 68. If desired, raised warp strands 20-1 may include two or more adjacent (e.g., consecutive) warp strands to create a float with conductive strand 80C in woven fabric 12. The float may provide a longer conductive segment for receiving component 26 while ensuring that warp strands 20 do not interfere with component insertion. The float formed by conductive weft strand 80C may pass over two, three, or more than three warp strands 20 in fabric 12.

The warp strands 20 that are selected to be raised or lowered relative to other warp strands 20 may be based on the timing at which component 26 is expected to reach component-receiving region 32. The timing may be based on the length of strand 80C between component detector 44 and component-receiving region 32, for example.

If desired, other adjustments may be made to equipment 98 in response to detecting component 26 with detector 44. For example, equipment 98 may be adjusted to form a pocket such as pocket 66 (FIG. 2) between outer woven fabric layers in preparation for receiving conductive strand 80C and component 26. The example of FIG. 10 is merely illustrative.

Figure 11:
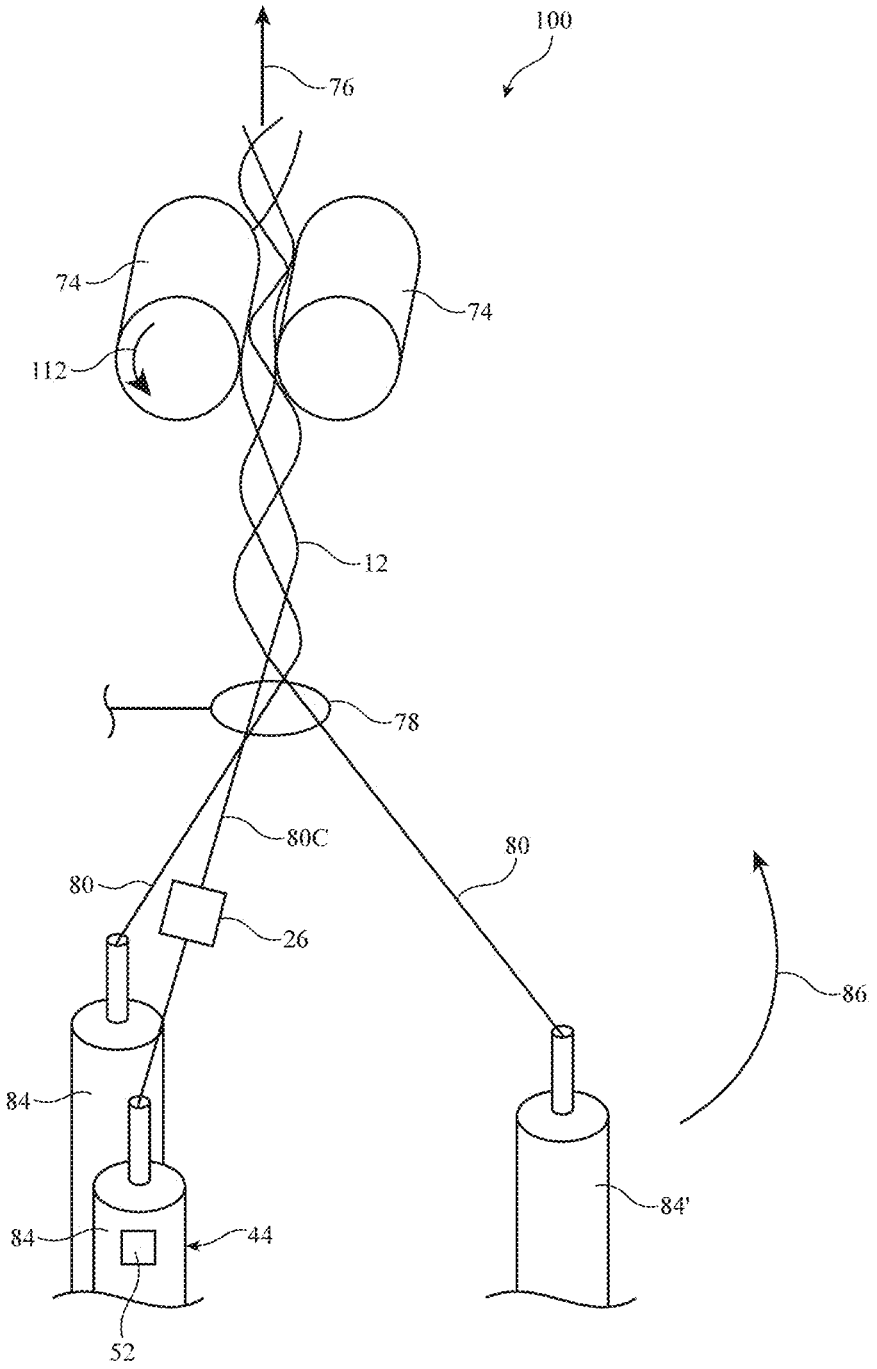
FIG. 11 is a perspective view of illustrative braiding equipment having members that are adjusted to accommodate an electrical component in response to detecting the electrical component with a component detector in accordance with an embodiment.

FIG. 11 is a perspective view of illustrative interlacing equipment 46 such as braiding equipment 100 receiving strand 80C from component detector 44. Braiding equipment 100 may include carriers 84. Carriers 84 may be mounted to rotating horn gears or other rotating members and may include bobbins for dispensing strands 80. As the horn gears rotate, carriers 84 may be transferred between the horn gears and the bobbins may pass over and under one another in an alternating fashion (e.g., each carrier 84 may follow a pseudo-sinusoidal path or figure eight path, depending on the number of carriers 84) to create a braid such as braided fabric 12 (e.g., braided fabric 12 of the type shown in FIG. 4 or other suitable braided fabric). Braided fabric 12 may be taken up by rollers 74 that rotate in direction 112 to guide braided fabric 12 upwards in direction 76. A braiding hoop or other ring 78 may be used to adjust the braiding angle.

If desired, conductive strands may be incorporated into braided fabric 12. Conductive strands 80C may be braided strands that are braided to form a covering or tubular braid, may be core strands at the core of braided strands, may be inlaid strands that extend along the longitudinal axis of the braid without being braided (e.g., in a biaxial or triaxial braid), or may be other suitable strands in fabric 12.

In some arrangements, a component detector 44 of the type described in connection with FIGS. 5, 6, 7, and 8 may feed conductive strand 80C to braiding equipment 100. For example, component detector 44 may feed conductive strand 80C to carriers 84. In other arrangements, component detector 44 may be integrated with one or more of the components of braiding equipment 100 such as carriers 84. In the example of FIG. 11, component detector 44 is integrated with one or more of carriers 84 (e.g., sensors 52 may be incorporated into carrier 84).

In response to information from component detector 44 indicating that component 26 has reached component detector 44 (e.g., in response to sensor data from sensors 52 in detector 44), controller 48 may be configured to adjust one or more components of braiding system 100 to accommodate component insertion. For example, as shown in FIG. 11, one or more carriers such as carrier 84' may follow a different path such as modified path 86 to avoid interfering with component 26 as strands 80 are braided around component 26. Path 86 may be further away from the braiding axis to allow additional space for conductive strand 80C and component 26 to be incorporated into the braid.

If desired, other adjustments may be made to equipment 100 in response to detecting component 26 with detector 44. For example, equipment 100 may be adjusted to form one or more floats such as float 92 (FIG. 4) with conductive strand 80C. The example of FIG. 11 is merely illustrative. The float may provide a longer conductive segment for receiving component 26 while ensuring that other braided strands 80 do not interfere with component insertion.

Figure 12:
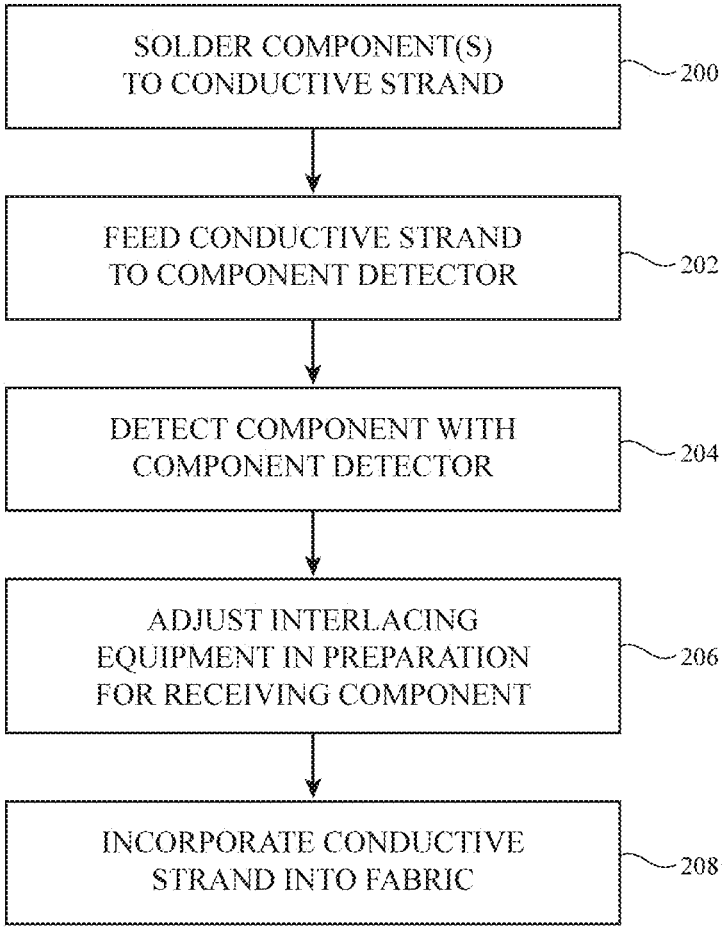
FIG. 12 is a flow chart of illustrative steps involved in forming fabric with electrical components using a component detector in accordance with an embodiment.

FIG. 12 is a flow chart of illustrative steps involved in forming fabric with electrical components using a component detector.

During the operations of block 200, one or more components 26 may be electrically and mechanically coupled to a conductive strand such as conductive strand 80C. If desired, electrical component 26 may have one or more grooves of the type shown in FIG. 2. The solder connection or other electrical connection between conductive strand 80C and component 26 may be located in the grooves. Arrangements in which component 26 does not have grooves may also be used. There may be one, two, three, ten, twenty, more than twenty, or less than twenty components 26 mounted to a given conductive strand 80C.

During the operations of block 202, the conductive strand 80C may be fed to component detector 44. Component detector 44 may be a dedicated component detector that feeds conductive strand 80C to interlacing equipment 46, or component detector 44 may be integrated with one or more of the components in interlacing equipment 46.

During the operations of block 204, component detector 44 may detect the presence of component 26. This may include, for example, using sensors 52 to detect component 26 between arms 106, on shuttle 60, on carrier 84, and/or on other suitable interlacing components that include component detector 44.

During the operations of block 206, controller 48 may adjust one or more members of interlacing equipment 46 in response to detecting component 26 with component detector 44. This may include raising or lowering needles to create floats 90 (FIGS. 3 and 9), adjusting guide bars to form pockets between outer knit layers, raising or lowering warp threads to create floats or pockets 66 (FIGS. 2 and 10), adjusting carrier paths for carriers 84 to create floats 92 (FIGS. 4 and 11), and/or adjusting other components in interlacing equipment 46 to create component-receiving regions 32 in fabric 12 in preparation for incorporating conductive strand 80C with component 26 into fabric 12.

During the operations of block 208, interlacing equipment 46 may continue interlacing operations to incorporate conductive strand 80C and component 26 into fabric 12. Due to the preparation steps of block 206, component receiving regions 32 may be created in precisely the locations where components 26 land within fabric 12 once conductive strand 80C is incorporated into fabric 12.

The foregoing is merely illustrative and various modifications can be made by those skilled in the art without departing from the scope and spirit of the described embodiments. The foregoing embodiments may be implemented individually or in any combination.

What is claimed is:

1. Equipment for forming fabric, the equipment comprising:

interlacing equipment selected from the group consisting of: knitting equipment, weaving equipment, and braiding equipment; and a component detector configured to feed a conductive strand to the interlacing equipment, wherein an electrical component is mounted to the conductive strand, wherein the component detector comprises a sensor configured to detect the electrical component on the conductive strand, and wherein the interlacing equipment comprises at least one adjustable member that is adjusted in response to the sensor detecting the electrical component.

2. The equipment defined in claim 1 wherein the interlacing equipment comprises the knitting equipment and wherein the at least one adjustable member comprises needles that are lowered in response to the sensor detecting the electrical component.

3. The equipment defined in claim 2 wherein the needles are lowered to create a float with the conductive strand in the fabric.

4. The equipment defined in claim 1 wherein the interlacing equipment comprises the weaving equipment and wherein the at least one adjustable member comprises warp strand positioners that raise and lower select warp strands in the fabric in response to the sensor detecting the electrical component.

5. The equipment defined in claim 4 wherein the warp strand positioners raise and lower the select warp strands to create a float with the conductive strand in the fabric.

6. The equipment defined in claim 1 wherein the interlacing equipment comprises braiding equipment and wherein the at least one adjustable member comprises a carrier that follows a modified path in response to the sensor detecting the electrical component.

7. The equipment defined in claim 6 wherein the carrier follows the modified path to create a float with the conductive strand in the fabric.

8. The equipment defined in claim 1 wherein the component detector comprises first and second movable arms separated by a gap through which the conductive strand is fed to the interlacing equipment.

9. The equipment defined in claim 8 wherein the movable arms are opened away from one another to widen the gap in response to the sensor detecting the electrical component.

10. The equipment defined in claim 1 wherein the sensor is selected from the group consisting of: a strain gauge sensor, an optical proximity sensor, and a capacitive proximity sensor.

11. A method for forming fabric, the method comprising:

with a feeder, feeding a conductive strand to interlacing equipment;

with a sensor in the feeder, detecting an electrical component on the conductive strand; and with the interlacing equipment, adjusting interlacing operations in response to detecting the electrical component with the sensor.

12. The method defined in claim 11 wherein the interlacing equipment comprises knitting equipment and wherein adjusting the interlacing operations comprises lowering needles in response to detecting the electrical component with the sensor.

13. The method defined in claim 11 wherein the interlacing equipment comprises weaving equipment and wherein adjusting the interlacing operations comprises using warp strand positioners to selectively raise and lower warp strands in response to detecting the electrical component with the sensor.

14. The method defined in claim 11 wherein the interlacing equipment comprises braiding equipment and wherein adjusting the interlacing operations comprises following a modified path with a carrier in response to detecting the electrical component with the sensor.

15. The method defined in claim 11 wherein adjusting the interlacing operations comprises adjusting the interlacing operations to form a component-receiving region in the fabric, wherein the component-receiving region has a different fabric construction than other regions of the fabric.

16. Equipment for forming fabric with an electrical component in a first region of the fabric, wherein the first region of the fabric has a different fabric construction than a second region of the fabric, the equipment comprising:

a feeder that feeds strands to interlacing equipment, wherein the strands include a conductive strand;

a sensor on the feeder that detects the electrical component on the conductive strand; and interlacing equipment that initiates formation of the first fabric region in response to the sensor detecting the electrical component.

17. The equipment defined in claim 16 wherein the interlacing equipment is selected from the group consisting of: knitting equipment, weaving equipment, and braiding equipment.

18. The equipment defined in claim 16 wherein the feeder comprises first and second movable arms separated by an opening and wherein the feeder feeds the conductive strand to the interlacing equipment through the opening.

19. The equipment defined in claim 18 wherein the movable arms are configured to open away from one another to widen the opening in response to the sensor detecting the electrical component.

20. The equipment defined in claim 16 wherein the sensor is selected from the group consisting of: a strain gauge sensor, an optical proximity sensor, and a capacitive proximity sensor.

* * * * *